United States Patent [19]

Swartout

[11] Patent Number: 4,638,307

[45] Date of Patent: Jan. 20, 1987

[54] PATIENT POSITION MONITORING SYSTEM

[76] Inventor: Willson C. Swartout, 31 Phoenix Ave., Newark, Del. 19711

[21] Appl. No.: 787,102

[22] Filed: Oct. 15, 1985

[51] Int. Cl.[4] ..... G08B 21/00

[52] U.S. Cl. ..... 340/666; 340/667; 340/686; 340/539; 340/573; 200/85 A

[58] Field of Search ..... 340/666, 665, 668, 667, 340/573, 547, 52 E, 52 D, 539, 686; 200/61.45 M, 61.58 B, 85 A, 85 R

[56] References Cited

U.S. PATENT DOCUMENTS

| | | | |
|---|---|---|---|
| 2,877,361 | 3/1959 | Chase | 340/547 |
| 3,247,502 | 4/1966 | Eberts | 340/547 |
| 4,195,287 | 3/1980 | McCox et al. | 340/666 |
| 4,228,426 | 10/1980 | Roberts | 340/666 |

*Primary Examiner*—Donnie L. Crosland
*Attorney, Agent, or Firm*—Mortenson & Uebler

[57] ABSTRACT

Apparatus is provided for determining when a weight has been lifted from a specific location. It is especially useful for sounding an alarm when an invalid patient attempts to get up from a chair or a bed. The apparatus comprises a very thin sealed reed switch affixed near the bottom of a compressible pad and a magnet affixed near the top of the pad, the reed switch being connected in an electrical circuit containing an alarm mechanism such that, when the pad is compressed and the magnet is in close proximity to the reed switch, the circuit is open and no alarm sounds, but when the weight causing the compression of the pad is lifted, the circuit closes and the alarm sounds. When a battery is used to power the electronics in a preferred embodiment, no power is drained in this system in use until the weight is removed, the life of the battery thereby approximating its shelf life. Time delays between lifting of the weight and sounding of the alarm can be provided by varying the compressibility of the pad or by providing an electronic time delay. A normally closed reed switch may be used or a normally open reed switch may be used.

8 Claims, 6 Drawing Figures

PATIENT POSITION MONITORING SYSTEM

BACKGROUND OF THE INVENTION

This invention relates, inter alia, to sounding an alarm when an invalid patient attempts to get up from a chair or bed. Such patients are usually held in place with a positioning belt which is generally uncomfortable and distasteful to the patient, who is usually capable of working his way out of such belts. This invention eliminates the need for a belt and returns some human dignity to the patient.

U.S. Pat. No. 943,940, issued in 1909, discloses a device to signal a ticket seller how many seats in a theatre were occupied, thus indicating the remaining number of seats that could be sold. It electrically sensed the weight of a person in a chair. Since then many variations of this concept have been devised. The apparatus of this invention is a unique, inexpensive reliable variation on this concept.

A magnetic reed switch consists of four basic parts: (1) glass capsule, (2) gas (atmosphere inside the glass capsule), (3) contacts and (4) reeds (leads). The reeds are hermetically sealed into the glass capsule in cantilever fashion so that the ends align and overlap, but with a small air gap in a normally open switch.

Because the reeds are ferromagnetic, the extreme ends will assume opposite magnetic polarity when brought into the influence of a magnetic field. When the magnetic flux density is sufficient, the attraction forces of the opposing magnetic poles overcome the reed stiffness causing them to flex toward each other and make contact. This operation can be repeated millions of times.

A biasing effect can be produced by placing a stationary magnet near a normally open reed switch to keep it closed. The approach of a second magnet with a reversed magnetic field will cancel the magnetic lines of force of the first magnet, and the switch will open.

SUMMARY OF THE INVENTION

Apparatus for issuing an alarm when a weight is lifted from a pad is provided, the apparatus comprising a compressible pad having a thin, sealed reed switch affixed near the bottom of the pad, and a magnet affixed near the top of the pad in approximate vertical and parallel registry with the switch, the reed switch being connected in an electrical circuit containing a power source and an alarm issuing means such that when the pad is compressed by a weight, causing the magnet to be in close proximity to the reed switch, no alarm issues, but when the weight is lifted and the pad decompresses, causing the magnet to move away from close proximity to the reed switch, the alarm issues. The apparatus is especially suitable for monitoring movement of invalids. The pad preferably comprises a compressible foam stuffing having a resilient, flexible, waterproof covering thereover, the covering encapsulating the foam, the reed switch and the magnet. The covering is preferably sewn over the foam and has at least one seam or port to pneumatically control the flow of air into and out of the pad, thereby causing a time delay of the alarm. The electrical circuit can have a built-in electrical time delay means to delay the issuing of the alarm after decompression of the pad by a desired amount of time. The alarm may be sound emitting or light emitting or both sound emitting and light emitting. In an alternate embodiment, when the pad decompresses and the magnet moves away from the reed switch, a signal may be sent to the alarm means via radio transmission to issue the alarm at a remote location.

DETAILED DESCRIPTION OF THE INVENTION AND PREFERRED EMBODIMENTS WITH REFERENCE TO THE DRAWINGS

Apparatus is provided for determining when a weight has been lifted from a specific location. It is especially useful for sounding an alarm when an invalid patient attempts to get up from a chair or a bed. The apparatus comprises a very thin sealed reed switch affixed near the bottom of a compressible pad and a magnet affixed parallel near the top of the pad, the reed switch being connected in an electrical circuit containing an alarm mechanism such that when the pad is compressed and the magnet is in close proximity to the reed switch, the circuit is open and no alarm sounds, but when the weight causing the compression of the pad is lifted, the circuit closes and the alarm sounds. When a battery is used to power the electronics in a preferred embodiment, no power is drained in this system in use until the weight is removed. Time delays between lifting of the weight and sounding of the alarm can be provided by varying the compressibility of the pad or by providing electronic time delays. A normally closed reed switch may be used or a normally open reed switch may be used.

Figure 1:
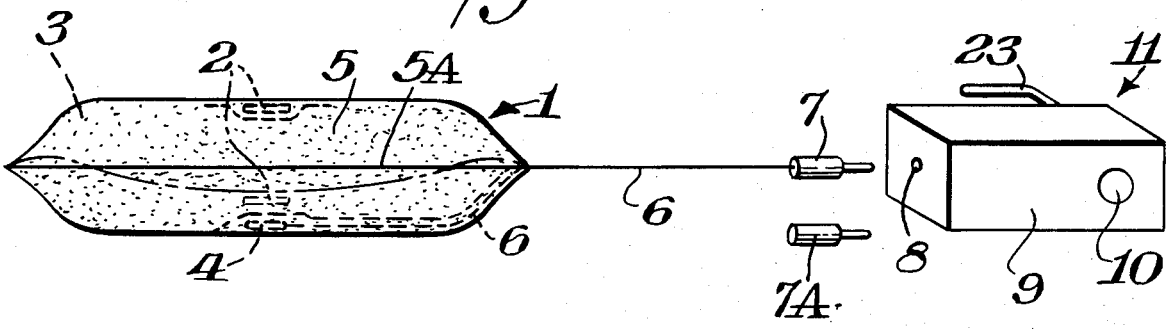
FIG. 1 is a schematic drawing of the pad means and alarm means according to the invention.
Figure 2:
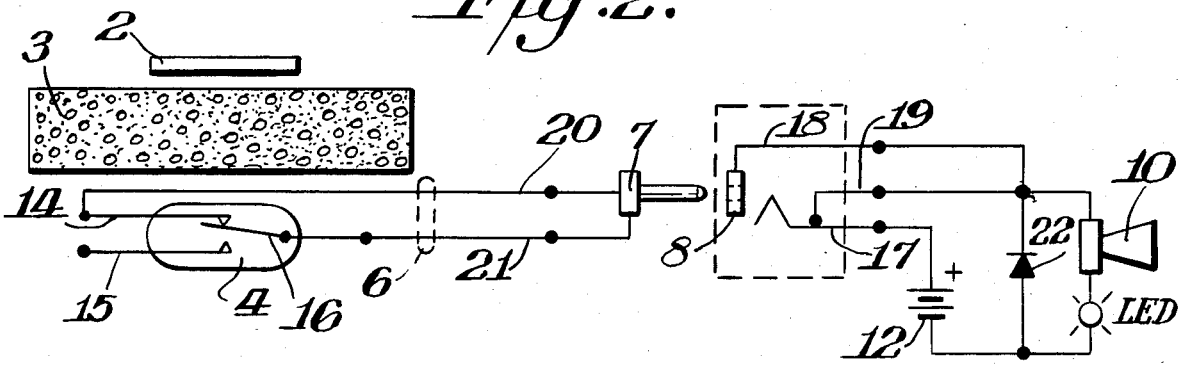
FIG. 2 is an electrical schematic diagram of the pad means of the invention with weight removed and disconnected from the alarm means.
Figure 3:
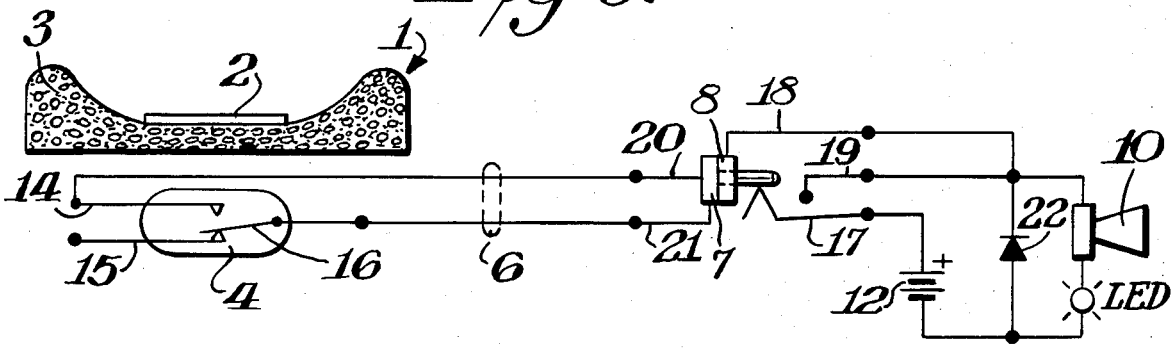
FIG. 3 is an electrical schematic diagram of the pad means with weight in place and connected to the alarm means.

The basic electrical circuit of the invention, shown in FIGS. 1–3, includes battery 12, switch 4 and load 10 connected in series, all known in the art. Making a very thin switch which causes two condutive metals to contact each other when pressure is applied is a fairly simple task and is known. However, according to this invention, a very thin switch is employed which causes two conductive metals to separate when pressure is applied. This invention requires a very thin switch to insure comfort when a patient is sitting on a pad containing the switch mechanism. When the patient is on the pad as depicted in FIG. 3, the circuit is open and draws no current. Therefore, battery life approaches its shelf life.

Figure 5:
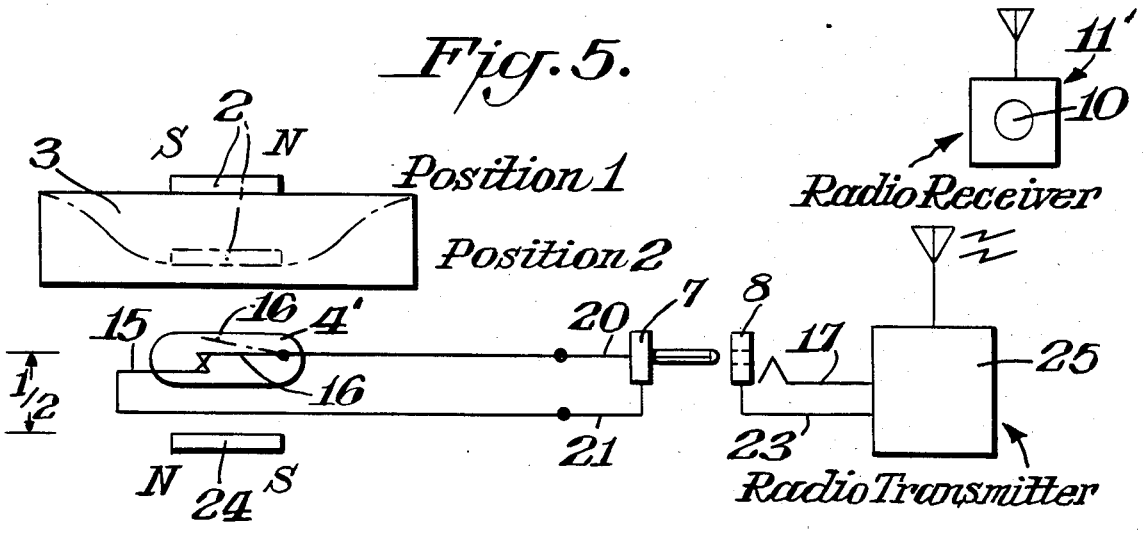
FIG. 5 is a schematic diagram of an alternate embodiment of the invention.

The electro-mechanical pad 1 of this invention is connected electrically as in FIG. 1 or via a radio transmitter as in FIG. 5 to an alarm-issuing annunciator 11. When there is pressure on the pad, no current is drawn from the low voltage battery. When a normally closed reed switch 4 is employed and pressure is removed, the normally closed switch 4 in the pad 1 closes thereby closing the circuit and an alarm is sounded. The alarm can be time delayed by several seconds by the unique pneumatic system of this invention. However, the delay could also be caused electronically. The sensing device in the pad is very thin and is totally hermetically sealed so that conductive liquids or moisture in the atmosphere cannot cause the battery current to drain.

In operation using a normally closed reed switch 4, shown in FIGS. 2 and 3, in which cover 5 is omitted for clarity of description, current leaves the plus side of the battery 12 and travels through contact 17 to wire 20, through contact 14 to contact 16 of reed switch 4, through wire 21 to contact 18 of socket 8, through horn 10, through the LED and back to the negative side of battery 12. Numeral 6 designates the combination of wires 20 and 21 which may be 2-lead lamp cord. When plug 7 is removed from socket 8, contacts 17 and 19 will close and horn 10 will sound. If magnet 2 is raised away from reed switch 4, then contacts 14 and 16 of reed switch 4 will close and horn 10 will sound. Key plug 7A is identical to plug 7, but has no wires and is normally stored at a location away from the patient. If open circuit key plug 7A is inserted into socket 8, then contacts 19 and 17 will open and horn 10 will not sound. A hook 23 can be located on the back of case 9 for affixing annunciator 11 to a wheel chair or the like. Reed switch 4 is preferably encapsulated in glass. A further enhancement would be to add heat shrinkable tubing to cover wire 20, reed switch 4 and wire 21 in order to seal all electrical parts against liquids and atmosphere.

In typical operation, initially key plug 7A is in socket 8. Horn 10 is off. Pad 1 is placed on a wheel chair seat. The patient is then placed in the wheel chair and annunciator 11 is hooked to the back rest of the wheel chair with hook 23, all simulated in FIGS. 1–3. Air is squeezed out of the compressible pad 1 as the patient rests. Pad 1 is preferably of compressible foam 3 covered with an air impermeable material 5, e.g. plastic or Naugahide®, and tightly sewn shut at seam 5A (of FIG. 1). As the patient sits, pad 1 compresses as air escapes through the seam 5A of pad 1. Magnet 2 approaches reed switch 4 and contacts 14 and 16 open. Key plug 7A is removed and horn 10 sounds because contact 17 and 19 close. This brief sounding of horn 10 prior to insertion of plug 7 constitutes a test of battery 12 and all the electronics except the pad portion. Plug 7 is then inserted into socket 8 and horn 10 shuts off. The patient is now electronically secured because contacts 14 and 16 are open as a result of the proximity thereto of magnet 2 to reed switch 4. The patient can shift around but horn 10 will not sound because pad 1 is under partial vacuum each time the patient lifts his weight. Magnet 2 cannot be forced away from reed switch 4 by the foam plastic 3 until enough air permeates in through seam 5A during decompression of pad 1. This can take several seconds. Therefore, the patient's minor movement will not cause false alarms.

If the patient decides to get up and does so, air slowly enters pad 1, magnet 2 slowly rises, and contacts 14 and 16 close, the circuit closes and horn 10 sounds. If the patient is sitting and wants to deactivate the unit so he can get up unnoticed, if he pulls plug 7, then horn 10 sounds because contacts 17 and 19 of socket 8 close. He cannot find an on-off switch because there is none.

If the patient is sitting, and if he is not bothersome, then by allowing him to have annunciator 11 with him, he could signal when he is hungry, etc., simply by pulling out plug 7. If the patient is bothersome, then annunciator 11 could be fastened out of reach.

Figure 4:
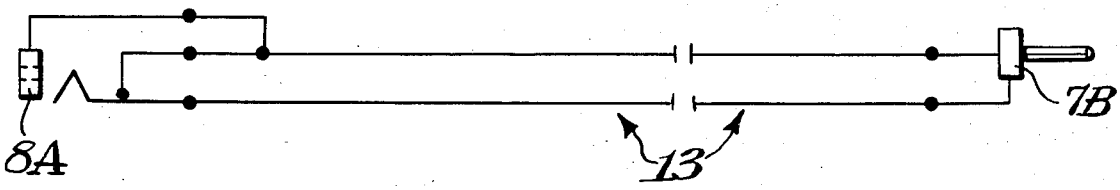
FIG. 4 is a schematic diagram of an extension cord suitable for use in connection with the invention.

If the patient is sitting, but upstairs for example, and the attendant desires to be downstairs or outside, the special extension cord 13 shown in FIG. 4, which can be fifty feet or longer in length, would allow annunciator 11 to be where horn 10 could more easily be heard. If the patient disconnects plug 7 from socket 8A of extension cord 13, the horn 10 will sound.

Pad 1 could also be used to switch on a portable radio transmitter which would cause a receiving device to sound as shown in FIG. 5. This would give the patient and the attendant total freedom of movement, provided the patient stayed on the pad.

An alternate method of construction of pad 1 would be to use two magnets and a normally open reed switch 4' as shown in FIG. 5. Near reed switch 4', a second magnet 24 is placed approximately half an inch away. Reed switch 4' contacts 15 and 16 then close. On top of the compressible plastic foam 3, the first magnet 2, with poles opposite to the one below, is placed. If the top magnet 2 is pressed toward reed switch 4', when it is approximately half an inch away the two magnetic fields are neutral as far as the reed switch 4' is concerned, and contacts 15 and 16 open. A radio transmitter 25 transmits a signal to annunciator 11' when first magnet 2 moves away from switch 4'.

An alternate embodiment of the invention could include an extra wide pad for use under the shoulders or buttocks of a patient in bed. Several reed switches with appropriate magnets could be wired in series. As long as the patient kept at least one magnet depressed, horn 10 would not sound. A battery charger could be plugged into socket 8. A charging current would then flow from contact 17 of FIG. 3 through battery 12, through diode 22, and exit contact 18.

A visual indicator shown as an LED (Light Emitting Diode) in FIGS. 2 and 3 could also be incorporated in series with horn 10 so as to more easily distinguish which patient of several being monitored is activating an alarm.

Figure 6:
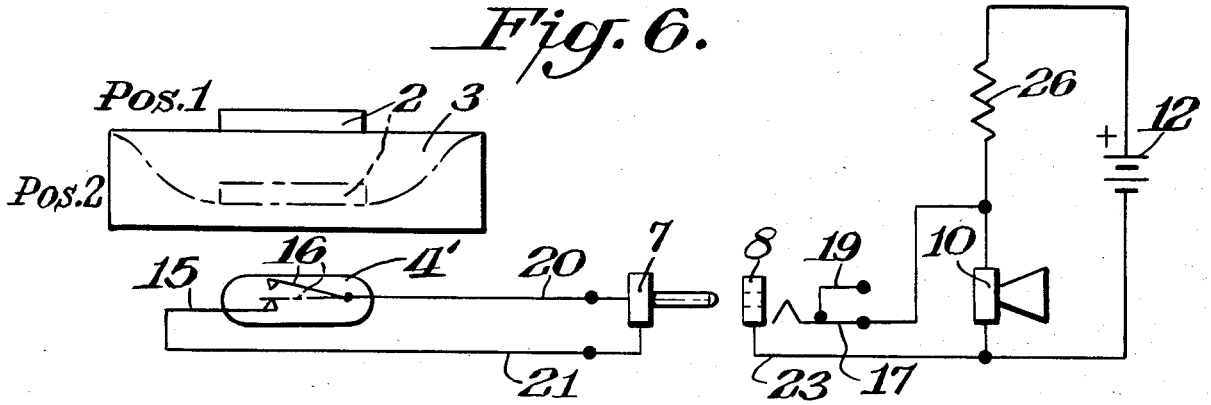
FIG. 6 is a schematic diagram of a further alternate embodiment of the invention.

A still further variation of this invention would be to use a normally open reed switch 4' and one magnet 2 in the circuitry, including resistor 26, as shown in FIG. 6. When magnet 2 approaches reed switch 4', it contacts 15 and 16 would close. This would be useful where a central annunciator with one large source of low voltage is available because the current drain of the closed contacts 14 and 16 would not be objectionable. Current flow for FIG. 6, with pad compressed, would be from the plus side of battery 12, through resistor 26, through reed switch 4', and back to the battery 12. No current would flow through the horn 10 and it would not sound off. If the magnet 2 was raised away from the reed switch 4', then reed switch 4' would open and current flow would be from the plus side of battery 12 through resistor 26, through horn 10 and back to the battery. Therefore, the horn would be sounding. The normally open reed switches 4' of FIG. 6 in the bed pad configuration would have to be wired in parallel instead of in series. A central control system could also use a normally closed reed switch 4 (pad 1) as decribed in FIGS. 1–3.

It will be evident to one skilled in the art that an electronic time delay could be employed instead of using the pneumatic delay effected by the pad 1 described herein.

A key feature of this invention is the thinness of the pad switch assembly using the resilient foam, reed switch and magnet. A sealed, normally closed reed switch, a magnet and a resilient pad substance all being approximately ⅛ inch in thickness when the assembly depressed is the preferred embodiment. All other methods of creating a switch sensitive to weight resulted in overly bulky devices. Thinness is important for patient comfort because patients sit on such pads for days, hour after hour.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for issuing an alarm when a weight is lifted from a pad switch assembly, said apparatus comprising a comressible pad, a thin sealed reed switch affixed on one side of said pad, and a magnet affixed on the opposite side of said pad in approximate close parallel registry with said reed switch, said reed switch being connected in an electrical circuit containing a power source and an alarm issuing means such that when said pad is compressed by a weight causing said magnet to be in closer proximity to said switch, the circuit is open and no alarm issues, but when said weight is lifted and said pad decompresses causing said magnet to move away from close proximity to said reed switch, the circuit closes and said alarm issues.

2. The apparatus of claim 1 wherein said pad comprises a compressible foam stuffing having a resilient, flexible, waterproof covering thereover, said covering encapsulating said foam, said reed switch and said magnet.

3. The apparatus of claim 2 wherein said covering is sewn over said foam and has at least one seam or port providing a pneumatic time delay.

4. The apparatus of claim 1 wherein said electrical circuit has a built-in time delay means to delay the issuing of said alarm after decompression of said pad by a desired amount of time.

5. The apparatus of claim 1 wherein said alarm is sound emitting.

6. The apparatus of claim 1 wherein said alarm is light emitting.

7. The apparatus of claim 1 wherein said alarm is both sound emitting and light emitting.

8. The apparatus of claim 1 wherein, when said pad decompresses, a signal is sent to said alarm means via radio transmission and said alarm issues.

* * * * *